US008197084B2

(12) United States Patent
Dubois

(10) Patent No.: US 8,197,084 B2
(45) Date of Patent: Jun. 12, 2012

(54) MOBILE ILLUMINATING DEVICE COMPRISING A TUBULAR HOUSING

(75) Inventor: Gilles Jean-Albert Bernard Dubois, Morangis (FR)

(73) Assignee: Stanley Works (Europe) GmbH, Dubendorf (CH)

( * ) Notice: Subject to any disclaimer, the term of this patent is extended or adjusted under 35 U.S.C. 154(b) by 0 days.

(21) Appl. No.: 12/753,541

(22) Filed: Apr. 2, 2010

(65) Prior Publication Data

US 2010/0188844 A1 Jul. 29, 2010

Related U.S. Application Data

(63) Continuation of application No. 12/068,103, filed on Feb. 1, 2008, now abandoned, which is a continuation of application No. 10/538,363, filed as application No. PCT/FR03/03643 on Dec. 9, 2003, now abandoned.

(30) Foreign Application Priority Data

Dec. 12, 2002 (FR) ..... 02 15746

(51) Int. Cl.
*F21L 4/04* (2006.01)

(52) U.S. Cl. ..... 362/202; 362/120; 362/184; 362/185; 362/194; 362/195; 362/196

(58) Field of Classification Search ..... 362/120, 362/184, 185, 194, 195, 196, 202
See application file for complete search history.

(56) References Cited

U.S. PATENT DOCUMENTS

| | | | | |
|---|---|---|---|---|
| 5,036,442 | A * | 7/1991 | Brown | 362/102 |
| 5,871,272 | A | 2/1999 | Sharrah et al. | |
| 6,227,677 | B1 * | 5/2001 | Willis | 362/196 |
| 6,231,207 | B1 | 5/2001 | Kennedy et al. | |
| 6,305,819 | B1 | 10/2001 | Chen | |
| 6,802,622 | B2 | 10/2004 | Hsien | |
| 2002/0024806 | A1 * | 2/2002 | Petzl et al. | 362/184 |
| 2002/0191396 | A1 | 12/2002 | Reiff et al. | |

FOREIGN PATENT DOCUMENTS

| | | |
|---|---|---|
| DE | 297 03 790 U1 | 7/1997 |
| WO | WO 02/03761 A1 | 1/2002 |

OTHER PUBLICATIONS

International Search Report of PCT/FR03/03643 dated May 4, 2004.
French Search Report dated Aug. 8, 2003.

* cited by examiner

*Primary Examiner* — William Carter
(74) *Attorney, Agent, or Firm* — Buchanan Ingersoll & Rooney PC

(57) ABSTRACT

A mobile illuminating device includes a generally cylindrical housing including: illuminating elements in the form of light-emitting diodes (LED) fixed on a support plate, electrical/electronic control and/or connectors between the illuminating elements and a battery. An axially extending section of the housing forms an interior space divided into a plurality of receptacles occupying respective circumferentially adjacent portions of the axial section. A first of the receptacles contains the diodes and a second of the receptacles contains batteries.

13 Claims, 2 Drawing Sheets

Fig. 1
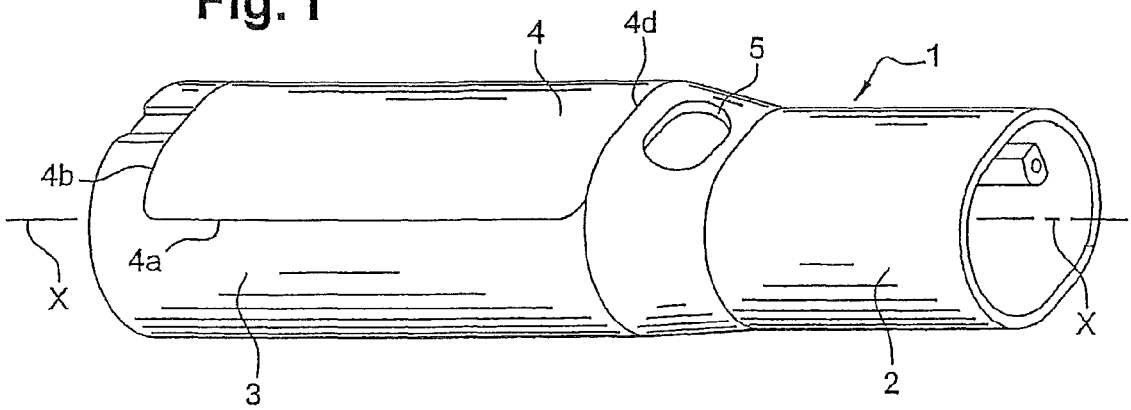
Fig. 2
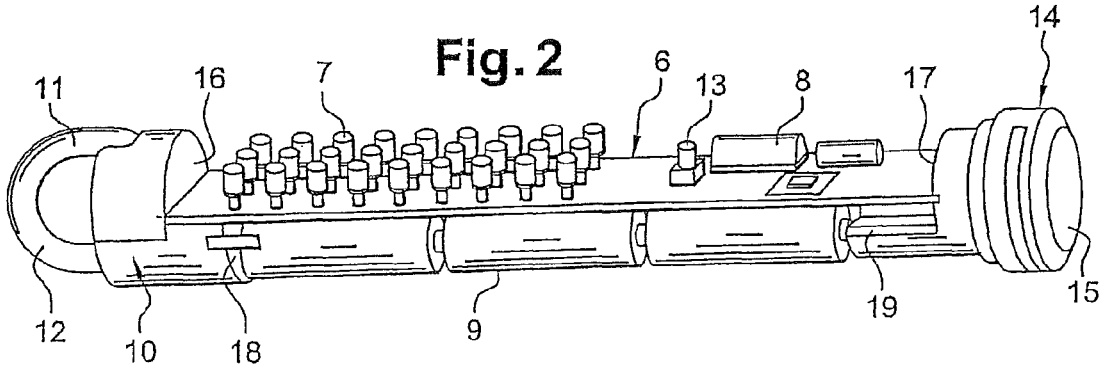
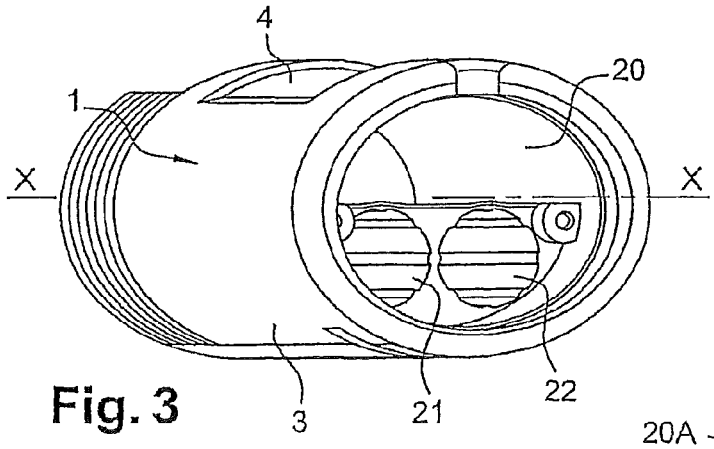
Fig. 3
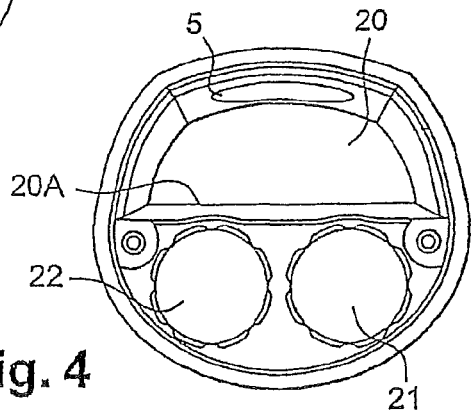
Fig. 4

MOBILE ILLUMINATING DEVICE COMPRISING A TUBULAR HOUSING

CROSS-REFERENCE TO RELATED APPLICATIONS

This application is a continuation of U.S. application Ser. No. 12/068,103 (now US 2008/0123329) filed on Feb. 1, 2008, which is a continuation of U.S. application Ser. No. 10/538,363 (now abandoned) filed on Jun. 13, 2005, which is a national stage application of International Application No. PCT/FR2003/003643 filed on Dec. 9, 2003, and which claims priority to French Application No. 02 15746 filed on Dec. 12, 2002, the entire content of which are incorporated herein by reference.

BACKGROUND

The present invention relates to a mobile illuminating device of the type comprising a housing of generally cylindrical shape, of axis (X-X) and presenting illuminating means in the form of light-emitting diodes (LED).

According to the prior art, ambulatory illuminating devices, called portable lamps, are known and used in particular by professionals in repair circles, particularly in the automobile field.

It is known to use electric portable lamps of which the illuminating elements are light-emitting diodes.

This type of device makes it possible to illuminate a precise spot in concentrated manner, and to optimize the life duration of the illuminating elements.

However, these devices are subject to improvement.

In effect, the devices according to the prior art cannot be used in any type of climatic condition, for example in the case of heavy rain or in a damp environment, without risking damaging the device by a phenomenon of short circuit.

Moreover, these devices are not adapted to withstand high pressures (rolling of a vehicle over the portable lamp) or shocks, particularly in the case of being dropped.

BRIEF DESCRIPTION OF A PREFERRED EMBODIMENT

The device according to the present invention solves these problems by presenting a device having optimal solidity and tightness, which is inexpensive to manufacture and simple to produce.

To that end, the mobile illuminating device of the type comprising a generally cylindrical housing of axis (X-X), including illuminating elements in the form of light-emitting diodes (LED) fixed on a support plate, electrical/electronic control and/or connecting means between said illuminating elements and a power source, is characterized by a single-piece housing.

So as to have an optimal light flow, the housing is transparent and its surface is covered, advantageously partially, by a sleeve made of semi-rigid, supple material.

In order to reduce production costs, the sleeve is made of plastics material, such as elastomer and is moulded on the housing.

In order to protect the illuminating elements and to allow a consequent light flow, the housing presents a window opposite them and the sleeve presents a cut-out at the level of said window.

The window is advantageously of parallelepipedic shape and is located longitudinally parallel to the axis (X-X).

In order to arrange and hold the support plate in the housing, the latter presents a first receptacle of semi-cylindrical shape of axis (X-X).

In order to allow the device to be used, the surface of the housing presents an opening of circular shape located opposite a push button disposed on the support plate.

In order to facilitate use of the device, the circular opening is located on an axis parallel to (X-X) and passes through the middle of the two smallest sides of the parallelepipedic window.

In order to allow the insertion into the housing of said power source in the form of batteries of format LR6 or accumulators of type AA, the housing presents second and third receptacles, both identical and of generally cylindrical shape, of axis parallel to (X-X).

With a view to holding and protecting the diodes of the support plate, the housing comprises a perforated plate, presenting slots adapted each to be traversed by a diode, and located between the housing and the support plate.

The device is advantageously capable of functioning either by accumulators or batteries disposed in the housing, or by supply from a D.C. source or on the mains via a supply line connecting the housing to said D.C. source or to the mains via a transformer.

In order to allow functioning on the mains or on accumulators, the housing comprises means capable of removably holding one or the other of two terminal parts, one comprising means for electrically recharging the accumulators located in said housing, the other being adapted to guide and hold a supply line at the outlet of the housing.

In order to allow the device to rest vertically on a horizontal plan, in stable manner, the housing is designed so as to present a planar terminal face transverse with respect to the longitudinal axis (X-X).

BRIEF DESCRIPTION OF FIGURES

The present invention will now be better understood in the light of the following description, which in no way limits the invention, with reference to the accompanying drawings, in which:

FIG. 1 shows the housing of the device according to the invention in a view in lateral perspective.

FIG. 2 shows the device according to the invention assembled, without the housing of FIG. 1.

FIG. 3 shows the housing of FIG. 1 in a view in lateral perspective from another angle of view.

FIG. 4 shows the housing of FIGS. 1 and 3 in transverse perspective.

DETAILED DESCRIPTION OF A PREFERRED EMBODIMENT

Figure 5:
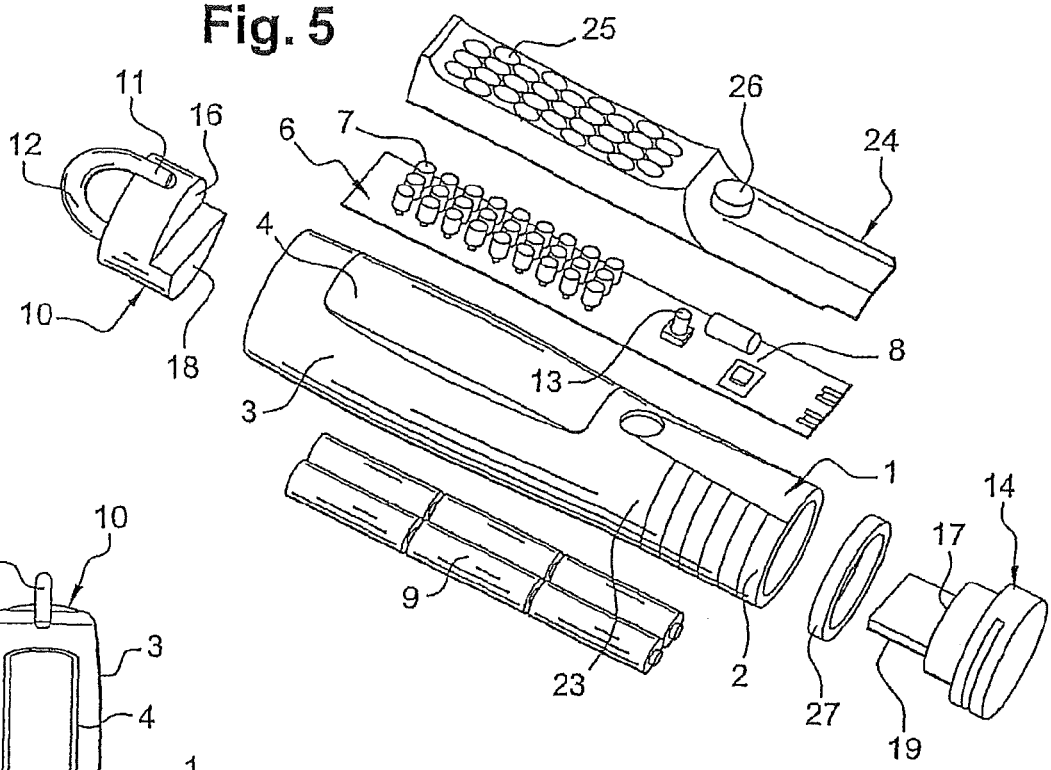
FIG. 5 shows an exploded view of the different elements of the device according to the invention.
Figure 5:
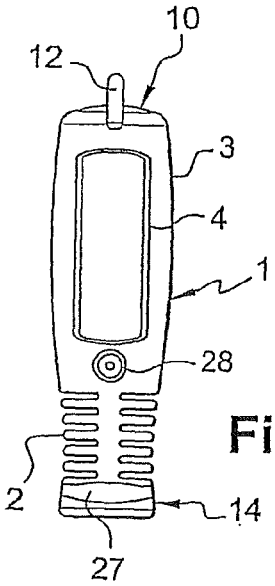

As illustrated in FIG. 1, the housing 1 of the mobile illuminating device is of generally cylindrical shape of axis (X-X) and presents an elliptic base or cross section.

For convenience, the notion of "assembled state" of the device in the following description signifies the state in which the different elements constituting the device according to the invention are assembled, thus allowing the latter to be operational.

Moreover, the device according to the invention will hereinafter be called portable lamp.

The housing 1 is made of a rigid material and preferably a thermoplastics material.

The housing 1 is made of a transparent material allowing the passage of the light while altering the light intensity as little as possible.

The housing 1 presents two parts: a part 2 for gripping and a part 3 for illuminating.

The gripping part 2 makes it possible to hold the portable lamp manually and thus to direct the illuminating part 3 towards the place having to be illuminated.

The illuminating part 3 comprises a window 4 of generally parallelepipedic shape.

The sides of the window 4 are of length equal in two's (4*a*, 4*c*) and (4*b*, 4*d*) and the two larger sides (4*a*, 4*c*) are parallel to axis (X-X).

The window 4 allows the passage of the flow of light without noteworthy reduction in intensity, when the portable lamp is assembled, in a direction substantially perpendicular to the longitudinal axis (X-X).

Between the gripping part 2 and the illuminating part 3, the housing 1 presents an opening 5 of circular shape located on an axis parallel to (X-X) and more precisely on the straight line passing through the middles of the two smallest sides of the window 4, viz. sides (4*b*, 4*d*).

The diameter of the circular opening 5 is smaller than the length of the smallest sides (4*b*, 4*d*) of the parallelepipedic window 4. By way of example, the diameter of the circular opening 5 is half the length of the smallest sides (4*b*, 4*d*) of the parallelepipedic window.

In FIG. 2, the portable lamp is shown without the housing 1 of FIG. 1.

The portable lamp presents a support plate 6 of generally rectangular shape, provided, on one of its faces, with a first zone comprising the illuminating means in the form of a set of light-emitting diodes 7 soldered on said plate 6, and with a second zone comprising electronic/electrical means 8 for control and/or connection between said illuminating elements 7 and a source of energy, represented here by batteries 9 of format LR6.

The support plate 6 is made of rigid material such as epoxy.

The light-emitting diodes 7 are ideally disposed in rows parallel to axis (X-X) on the support plate 6, for example three rows of nine diodes each.

In this way, the light flow emitted by the diodes 7 is directed in a direction perpendicular to axis (X-X), more precisely perpendicularly to the plane of the support plate 6.

In FIG. 2, the support plate 6 presents on its distal end (towards the diodes 7) a first cylindrical stopper 10.

The first cylindrical stopper 10 presents hooking means 11 in the form of a retractable hook 12, shown in FIG. 2 in its position retracted in the first cylindrical stopper 10.

The hook 12 is in free rotation about the axis (X-X) and is preferably made of a deformable semi-rigid supple material, such as an elastomeric material.

In this way, in the event of accidental traction, the device may be easily unhooked by deformation of the hook 12 without causing rupture of said hook 12 or damage on the portable lamp.

The hook 12, in rotation about axis (X-X) of the housing 1, also presents notching means (not shown here but of any known type) making it possible to block the hook 12 with respect to the housing 1 in a plurality of angular positions.

The support plate 6 comprises between the light-emitting diodes 7 and the electronic means 8, a push button 13 allowing said diodes 7 to be switched on when the device is assembled.

The support plate 6 presents on its proximal end (towards the electronic means 8) a second cylindrical stopper 14.

The second cylindrical stopper 14 presents a planar terminal face 15, thus allowing the portable lamp to rest vertically on a horizontal support, perpendicular to axis (X-X).

As will be explained hereinafter, the second cylindrical stopper 14 must be inserted by deformation in the housing 1, during assembling of the portable lamp, in order to allow a better tightness of the portable lamp.

The first (10) and second (14) cylindrical stoppers present means (16, 17) for centering and/or positioning the support plate 6 as well as means (18, 19) for electrical connection of the batteries 9 allowing the transmission of the energy contained in the batteries 9, when the device is assembled.

The push button 13 is connected in known manner to the diodes 7 in an electrical circuit represented by the electronic/electrical means 8.

The second cylindrical stopper 14 may be of two types: either it presents a planar surface 15 allowing a connection with a charger (not shown here but of any known type) thanks to means for electrically recharging the accumulators, and in this way the device according to the invention functions exclusively from an energy source in the form of rechargeable batteries, or it is connected to an electric wire (not shown here) allowing said device to function, or on the mains from an electric socket via a transformer of type known per se, or on a D.C. source supply.

FIGS. 3 and 4 represent the housing of FIG. 1 from two different angles of view.

FIG. 3 shows more precisely a three-quarter view in perspective on the interior of the housing seen from the illuminating part 3.

FIG. 4 shows a view in elevation of the interior of the volume of the housing 1, the illuminating part 3 being in the fore-ground.

Regarding FIGS. 3 and 4, the housing 1 forms an internal space, an axial section of which is divided into three internal receptacles occupying receptive portions of the space, which portions are circumferentially adjacent one another:

- a first receptacle 20 of generally semi-cylindrical shape of the same axis (X-X) and with diameter substantially equal to the diameter of the housing 1, thus defining a plane rectangular zone 20A, of width substantially equal to the diameter of the housing 1;
- second (21) and third (22) receptacles, both identical, of generally cylindrical shape, of axis parallel to (X-X) and of the same length as the first receptacle 16.

All three receptacles (20, 21, 22) have the same length but are all of length slightly less than the length of the housing 1.

In this way, the housing 1 presents at the level of its two ends a recessed part allowing the insertion therein of the first (10) and second (14) cylindrical stoppers.

The insertion of the first (10) and second (14) cylindrical stoppers is effected by partial elastic deformation thereof.

In this way, the tightness of the portable lamp in the assembled state is always ensured.

FIG. 5 shows an exploded view of the different elements which compose the portable lamp.

The housing 1 is covered with a sleeve 23 made of semi-rigid supple material such as an elastomer. The sleeve 23 is preferably applied by over-moulding.

The sleeve 23 covers the housing 1 entirely except for the parallelepipedic window 4 opposite the diodes 7 where it presents a cut-out.

The sleeve 23 is of homogeneous thickness except, possibly, at the level of the opening 5, and is ideally made of polyurethane.

A perforated plate 24, of the same length as the support plate 6, fits on the plate 6 and presents slots 25 allowing each of the light-emitting diodes 7 to be inserted by fit in each of the slots 25.

The perforated plate 24 therefore comprises as many slots 25 as light-emitting diodes 7.

Such a fit makes it possible for the light-emitting diodes 7 to be disposed inside the volume of the housing 1 and guarantees a better protection of the diodes 7, for example in the event of being dropped.

Moreover, the perforated plate 24 presents an orifice 26 allowing the push button 13 to project beyond the plane of the perforated plate 24 when the latter and the support plate 6 are fitted on one another.

The support plate 6, in connection by fit with the perforated plate 24, is inserted by translation at the level of the end of the illuminating part 3 inside the first semi-cylindrical receptacle 20 and rests on the plane rectangular zone 20A of the half-cylinder 20 which is perpendicular to axis (X-X).

The receptacle 20 therefore allows the positioning of the support plate 6 fitted with the perforated plate 24.

The support plate 6 is then held in position thanks to the first (10) and second (14) cylindrical stoppers which both present means (16, 17) for centering and/or positioning said support plate 6.

According to the particular representation of the portable lamp, the latter functions with the aid of six batteries 9 of LR6 type which may be inserted in groups of three in the second (21) and third (22) receptacles inside the housing 1.

Once the batteries 9 as well as the support plate 6 connected to the perforated plate 24 are inserted in the housing 1, the first cylindrical stopper 11 fits in the end of the illuminating part 3.

The second cylindrical stopper 14 likewise fits in the end of the gripping part 2.

The second cylindrical stopper 14 is held in position with the aid of a connecting ring 27 of type known per se.

Figure 6:
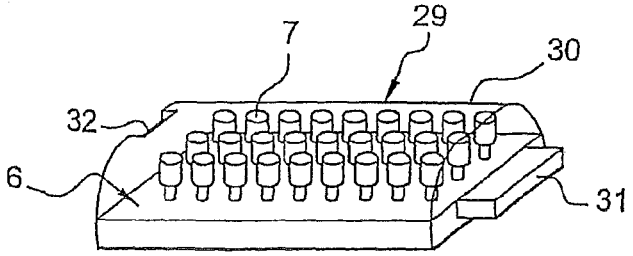
FIG. 6 shows the device according to the invention, disposed vertically, in front view.

FIG. 6 shows the portable lamp adapted to be used.

The housing 1 is covered by the sleeve 23 which covers the opening 5 but not the parallelepipedic window 4 of the housing 1 opposite the diodes 7.

The portable lamp obtained is perfectly tight due to the small number of points of connection between the different elements, i.e. between the first cylindrical stopper 11 and the housing 1 at the level of the end of the illuminating part 3 as well as between the housing 1, the connecting ring 27 and the second cylindrical stopper 14 at the level of the end of the gripping part 2.

The portable lamp thus constituted presents a zone 28 for switching on.

In effect, when the perforated plate 24 is fitted with the support plate 6, the push button 13 projects beyond the plane of the perforated plate 24 and may therefore always be activated or deactivated.

The insertion in the housing 1 of this assembly of plates (6, 24) does not prevent access to the push button 13 since the circular opening 5, located opposite said push button 13, allows access thereto.

The sleeve 23 made of elastomer presenting, at the level of the push button 13 and the circular opening 5, a reduced thickness with respect to the rest of the surface of the sleeve 23, a slight pressure exerted by the user's finger at the level of the switching-on zone 28 activates (or deactivates) the push button 13 through the sleeve 23, and thus allows the device according to the invention to be switched on.

In this way, the tightness of the device is not affected by the zone of the switching-on point 28.

Figure 7:
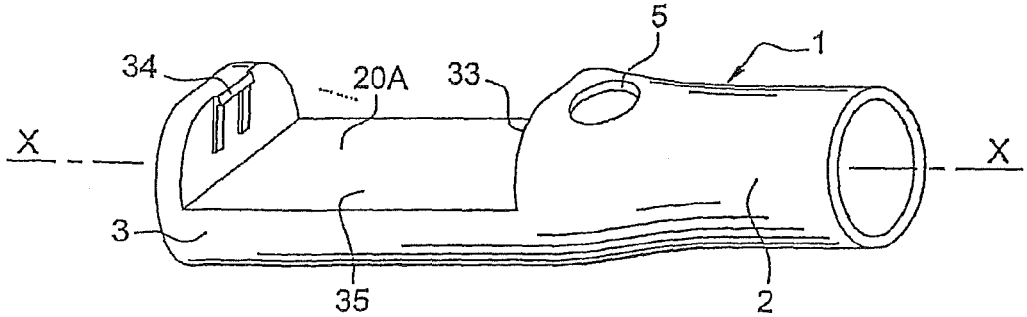
FIG. 7 shows an exploded view of an alternative embodiment of the device.

According to another preferred representation of the invention in FIG. 7, where elements similar to those of the preceding Figures bear the same reference numerals, the support plate 6 presents a one-piece removable part 29, constituted by:

said illuminating elements 7 in the form of light-emitting diodes 7;

a transparent protection window 30, of generally semi-cylindrical shape, with longitudinal axis parallel to the longitudinal axis of the housing 1, located opposite said illuminating elements 7;

means for removably fixing said removable part 29 on said housing 1, said removable fixing means being composed of first (31) and second (32) means for fixing said removable part 29 to the housing 1, said housing presenting first (33) and second (34) means for connecting said housing 1 to said fixing means (31, 32).

The removable part 29 presents a generally parallelpipedic shape which fits in the housing 1 by insertion of the first fixing means 31 in the first connection means 33 and by fit of the second fixing means 32 with the second connection means 34.

In FIG. 7, the first fixing means 31 are generally parallelepipedic in shape and are inserted in the first connection means 33 (not shown in the Figure) but which present a shape complementary to the first fixing means 31.

After the insertion of the first fixing means 31 in the first connection means 33, it is then possible to fit the removable part 29 completely in the housing 1 by placing in contact the second fixing means 32 with the second connection means 34 and by a slight pressure exerted for example on the protection window 29.

The first fixing means 31 likewise present electrical connection means (of type known per se) allowing the illuminating elements 7 to be electronically connected to the electrical/electronic control means 9.

According to FIG. 7, the second fixing means 32 are constituted by a recess in the removable part 29 and the second connection means 34 are constituted by an element projecting in the housing 1, the shape of the projection being complementary with the shape of the recess.

The housing 1 preferably presents a receiving receptacle 35 of shape complementary to the shape of the removable part 29.

The illuminating parts 7 are preferably provided to emit in the visible or ultra-violet range.

The invention claimed is:

1. Mobile illuminating device comprising a generally cylindrical housing defining a longitudinal axis (X-X), including: illuminating elements fixed on a support plate extending substantially along the axis (X-X), wherein some of the illuminating elements on the plate are spaced apart in the direction of the axis; electronic connectors between said illuminating elements and a battery power source; the housing being in one piece and made of transparent material, wherein the housing forms an internal axial space, an axially extending section of which space being divided into axially extending internal receptacles occupying respective circumferentially adjacent portions of the axial section, first and second ones of the receptacles being separated by said support plate wherein:

one of the receptacles being of generally semi-cylindrical shape and defining a plane rectangular zone occupied by the support plate carrying the illuminating elements;

another of the receptacles configured as a battery receptacle for receiving the battery power source, the housing is covered with a sleeve made of semi-rigid material; and the sleeve presents a reduced thickness at a level of the push button.

2. Device according to claim 1 wherein a portion of the housing forms a manual grip surrounding portions of the receptacles.

3. Device according to claim 1 wherein said receptacles are all of a length slightly less than a length of said housing.

4. Device according to claim 1, wherein the housing presents at its two ends a first and a second cylindrical stoppers for centering and/or positioning the support plate.

5. Device according to claim 1, including a perforated plate of a length the same as a length of the support plate, the perforated plate being fitted on the support plate and presenting slots in which each of the illuminating elements is inserted.

6. Device according to claim 1, wherein a surface of said housing presents an opening, located opposite a push button disposed on said support plate.

7. Device according to claim 1, wherein the illuminating elements comprise light emitting diodes.

8. Device according to claim 1, wherein the plane rectangular zone has a width oriented perpendicular to the axis, the width being substantially equal to a diameter of the housing.

9. Device according to claim 1, wherein a removable part located on a plane rectangular zone defined by the housing along the longitudinal axis of the housing presents a shape complementary to a receiving receptacle or recess of the housing, said removable part comprising:

said support plate;

said illuminating elements fixed on the support plate; and a perforated plate extending in the axial direction in overlying relationship to said support plate and including a section thicker than said support plate and presenting holes each receiving an illuminating element inserted therein.

10. Device according to claim 9, wherein the housing comprises means for removably fixing said removable part on said housing, said removable fixing means being composed of first and second means for fixing said removable part to the housing.

11. Device according to claim 9, wherein the illuminating elements comprise light emitting diodes.

12. Device according to claim 1, the housing presenting at least one internal receptacle and containing an axially extending perforated plate of the same length as the support plate, the perforated plate fitted on the support plate and including a section thicker than said support plate and presenting holes in which respective illuminating elements are inserted.

13. Device according to claim 12, wherein the illuminating elements comprise light emitting diodes.

* * * * *